US007762866B2

(12) United States Patent
Hui

(10) Patent No.: US 7,762,866 B2
(45) Date of Patent: Jul. 27, 2010

(54) INTERACTIVE ROCKING CRADLE AND DOLL

(76) Inventor: Man Kit Hui, 312-5 Peninsula Centre, 67 Mody Road, TST East, Hong Kong (HK)

( * ) Notice: Subject to any disclaimer, the term of this patent is extended or adjusted under 35 U.S.C. 154(b) by 259 days.

(21) Appl. No.: 12/046,594

(22) Filed: Mar. 12, 2008

(65) Prior Publication Data

US 2009/0233517 A1 Sep. 17, 2009

(51) Int. Cl.
*A63H 3/52* (2006.01)
*A63H 3/28* (2006.01)

(52) U.S. Cl. ..... 446/297; 446/227; 446/397

(58) Field of Classification Search ..... 446/227, 446/268, 297, 298, 301, 304, 318, 337, 343–346, 446/397, 479, 482, 484; 472/118, 119
See application file for complete search history.

(56) References Cited

U.S. PATENT DOCUMENTS

| | | | | |
|---|---|---|---|---|
| 5,941,750 | A * | 8/1999 | Pracas | 446/130 |
| 6,358,113 | B1 * | 3/2002 | Ruggiero | 446/482 |
| 6,561,915 | B2 * | 5/2003 | Kelly et al. | 472/119 |
| 6,663,393 | B1 * | 12/2003 | Ghaly | 434/262 |
| 6,729,934 | B1 * | 5/2004 | Driscoll et al. | 446/297 |
| 7,120,257 | B2 * | 10/2006 | Mahoney | 381/56 |
| 2001/0031602 | A1 * | 10/2001 | Sagi-Dolev | 446/227 |
| 2008/0014830 | A1 * | 1/2008 | Sosnovskiy et al. | 446/297 |

* cited by examiner

*Primary Examiner*—Nini Legesse
(74) *Attorney, Agent, or Firm*—Eric Hanscom; Todd Langford

(57) ABSTRACT

An interactive rocking cradle and doll is disclosed where, when the cradle is rocked with the baby inside of it, the cradle emits music and baby sounds. If the cradle is rocked without the baby, however, then the cradle only emits music but no baby sounds. None of the electronics required to emit the sounds are located in the doll, thereby allowing the doll to be created in a real and life-like manner.

2 Claims, 3 Drawing Sheets

INTERACTIVE ROCKING CRADLE AND DOLL

CROSS REFERENCE TO RELATED APPLICATIONS

None

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of toy dolls, and more specifically toward an interactive rocking cradle and doll where, when the cradle is rocked with the baby inside of it, the cradle emits music and baby sounds. If the cradle is rocked without the baby, however, then the cradle only emits music but no baby sounds. None of the electronics required to emit the sounds are located in the doll, thereby allowing the doll to be created in a real and life-like manner.

Dolls have been around for thousands of years, mainly as toys for small children. As times have progressed, these dolls have become more and more sophisticated. Batteries and electronics have been added to these dolls, as well as moving parts. Children and parents continue to expect more technologically advanced features present in the dolls they purchase. With this, they expect dolls to reflect real life situations.

It is known in the prior art to have dolls that emit sound. However, placing electronics and power sources inside of the doll cause it to become heavy and can give the doll an odd shape or feel. This results in a doll that is not very life-like. The individual holding the doll can feel the electronics when holding the doll, especially if the doll is not made of a hard material such as plastic. When children play with the dolls, the heavy weight can be burdensome, reducing the overall enjoyment and benefit of playing with the doll.

Thus there has existed a long-felt need for a doll that can be rocked, where it appears that the doll emits sound while it is being rocked, but when picked up, is not too heavy Further, when the cradle is rocked without the doll, it should not emit baby sounds, since the baby is not there. It should not feel like a sack filled with electronics or batteries, nor should it feel like a hard shell that holds heavy electronics and batteries.

The current invention provides just such a solution by having an interactive rocking cradle and doll where, when the cradle is rocked with the baby inside of it, the cradle emits music and baby sounds. If the cradle is rocked without the baby, however, then the cradle only emits music but no baby sounds. None of the electronics required to emit the sounds are located in the doll, thereby allowing the doll to be created in a real and life-like manner.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

This invention is a child's toy, where there is a rocking cradle and a doll. The rocking cradle comprises a power source, a speaker, an integrated circuit, and a motion sensor. When the cradle is rocked back and forth, the motion sensor senses this motion, and sends an electronic signal, or simply a signal, to the integrated circuit. The integrated circuit then sends a signal to the speaker, causing it to emit sound. The sound that the speaker emits can be that of a baby, as if a real baby were being rocked. Alternatively, crying sounds could be emitted until the motion sensor senses rocking, and then other sounds or no sounds could be emitted. With the doll located in the rocking cradle, it is as if it is the doll making the sounds, not the cradle. There can be straps attached to the rocking cradle that are used to secure the doll to the rocking cradle.

The cradle can also include a two-way switch and a button. The two-way switch changes the mode that the cradle is in, and can either be in the on position or the limited function position. When the switch is in the on position, the cradle is fully functional. Power is supplied to all the components that require power. When the switch is in the limited function position, the integrated circuit will not respond to input from the motion sensor. Instead, the integrated circuit accepts input from the button. This button, also known as a try-me button, allows a user who has not purchased the product, to press a button to hear a sample output from the speaker. By pressing the button, the user can hear the sounds emitted from the cradle as if the cradle were being rocked.

An additional button can also be placed in the cradle. This button, known as a doll button, senses whether there is a doll in the cradle. This can be a simple button that is activated when the weight of the doll presses down upon it. When the doll is in the cradle and the cradle is rocked, the cradle will emit music and baby sounds. However, if the doll is not located in the cradle and the cradle is rocked, the cradle will emit music but not baby sounds. This resembles a more real-life situation, where if there is no baby in the cradle, then there should be no baby sounds emitted.

The eyes of the doll are preferably weighted, as known in the prior art, to have the eyes open when the doll is in a more vertical or upright position, and closed when in a more horizontal or lying down position.

It is a principal object of the invention to provide a child's toy that imitates the activities and responses of a real child that is being rocked in a cradle or held by the user.

It is another principal object of the invention to provide a child's toy that is fun and entertaining to use.

It is a final object of this invention to provide a child's toy that is safe and efficient to operate.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
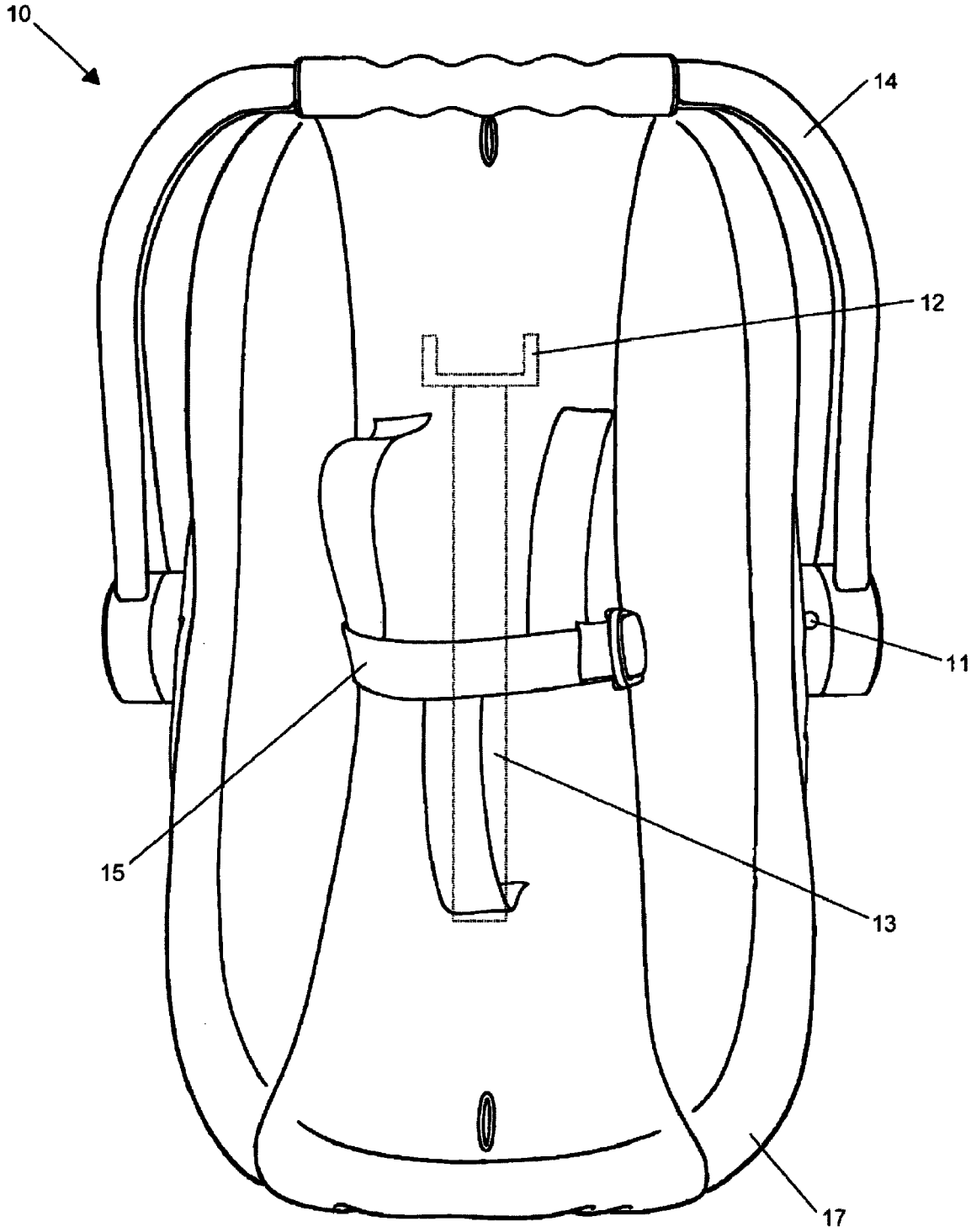
FIG. 1 is a front view of the rocking cradle.

FIG. 1 is a front view of the rocking cradle. A cradle 10 is shown in this figure. There is a try-me button 11 located on one side of the cradle 10. A cradle cover 17 is used to cover majority of the front side of the cradle 10. A doll button 12 is located near the middle of the cradle 10 underneath the cradle cover 17, and can optionally be connected to a doll strap 13, also underneath the cradle cover 17. This doll strap 13 pulls on the doll button 12 when the doll (not shown in this figure) is placed in the cradle 10, thereby providing an additional means to depress the doll button 12 when the doll is placed in the cradle 10. There is also a handle 14 that is used for carrying and rocking the cradle 10 as well as straps 15 to secure a doll to the cradle 10. Alternatively, other means of securing the doll to the cradle are available, such as hook and loop fasteners and magnets.

Figure 2:
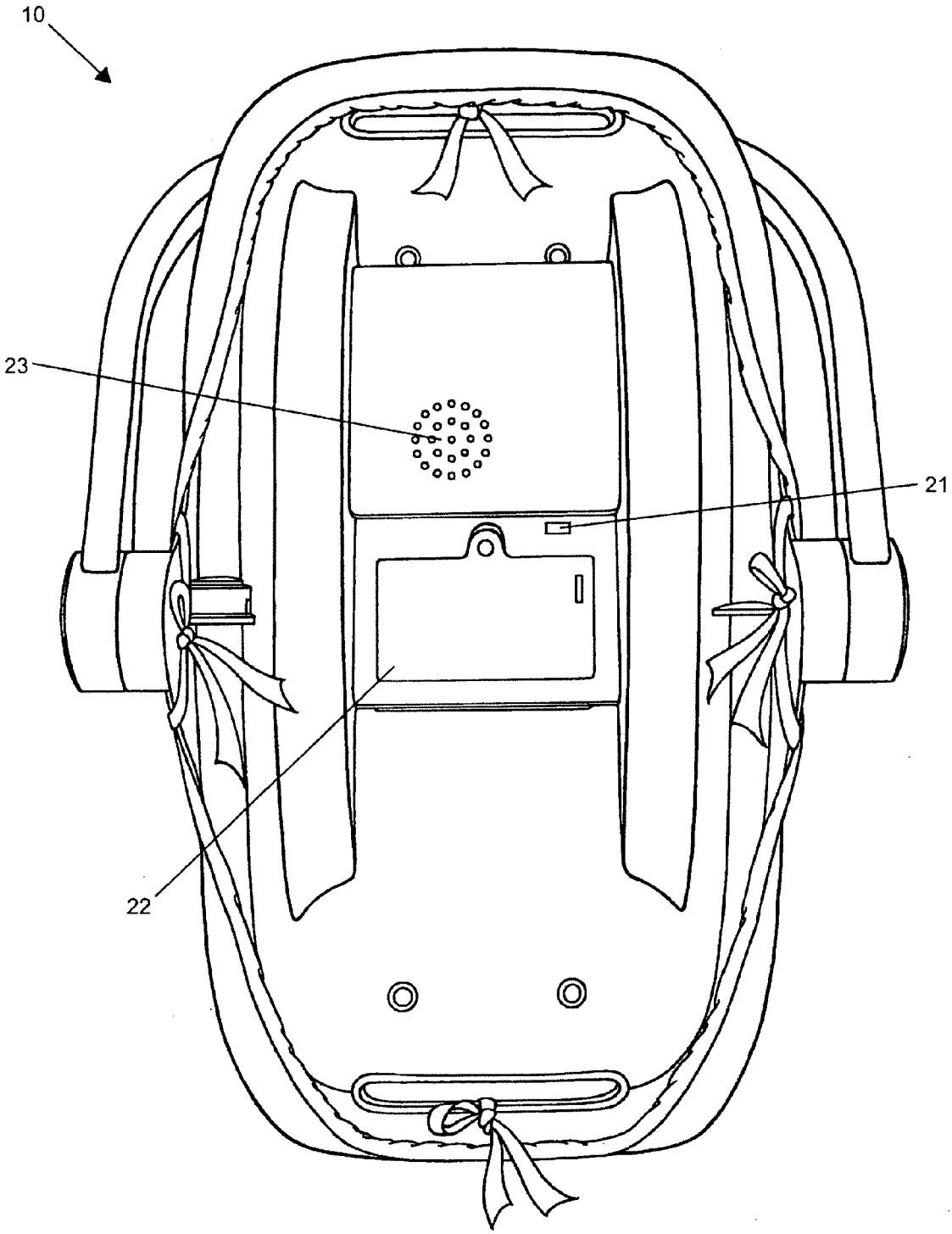
FIG. 2 is a rear view of the rocking cradle.

FIG. 2 is a rear view of the rocking cradle. The cradle 10 has a two-way switch 21, which switches the cradle from the fully functional mode to the limited function mode. A power source 22 powers the cradle. Preferably, two "AA" sized batteries are used to power the cradle 10, but a different number or different size of batteries may be used to achieve the same purpose. A speaker 23 is also located in the back, which emits sound based upon input from the integrated circuit (not shown in this figure).

Figure 3:
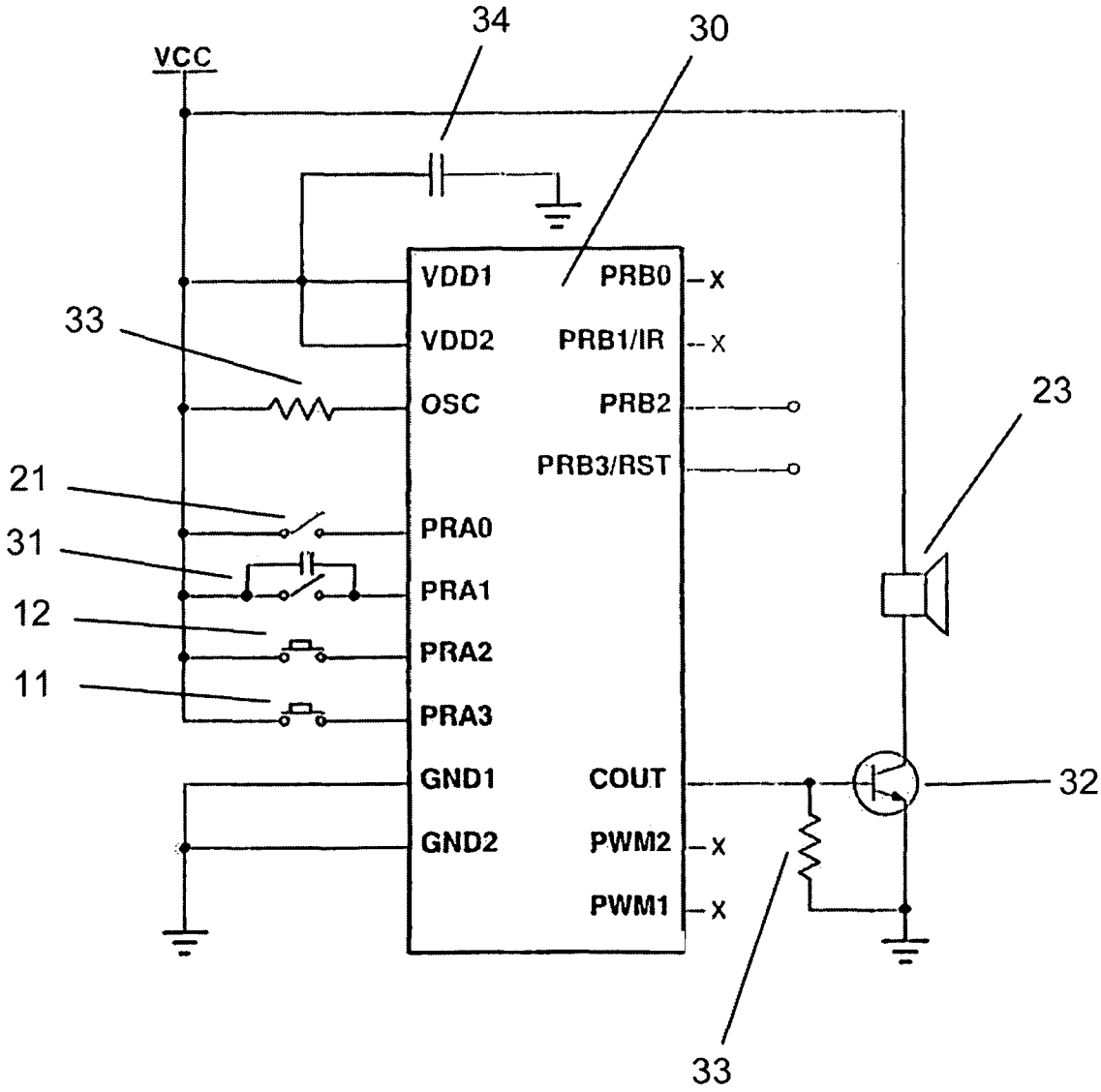
FIG. 3 is a circuit diagram of the rocking cradle.

FIG. 3 is a circuit diagram of the rocking cradle. The circuit preferably has a working voltage of 3 to 4.5 volts. An integrated circuit 30 is connected to various electronic components by means of wires and accepts input from some components and sends output to other components. There is a speaker 23 that receives input from the integrated circuit 30. There is a try-me button 11, a doll button 12, a two-way switch 21, and a motion sensor 31, all of which can be input to the integrated circuit 30. When the two-way switch 21 is closed, the integrated circuit accepts input from the motion sensor 31. When the two-way switch 21 is open, the integrated circuit does not accept input from the motion sensor 31, but rather accepts input from try-me button 11. Optionally, the integrated circuit 30 will not accept input from the motion sensor 31 unless the doll button 21 is being depressed, generally, by the presence of a doll (not shown in this figure). Input to the integrated circuit 30 can cause various output, including output to the speaker 23 causing the speaker 23 to emit sound. As a part of this circuit, there is a NPN transistor 32 as well as resistors 33 and capacitors 34.

What I claim is:

1. A method of using a child's toy comprising the steps of:

first, obtaining a toy rocking cradle and a doll, where the cradle comprises a power source, a speaker, an integrated circuit, a motion sensor, a two-way switch, a try-me button, a doll-button, and a means for securing the doll to the toy rocking cradle, where the try-me button, when pressed, sends a signal to the integrated circuit, where the motion sensor, when it senses a rocking motion, sends a signal to the integrated circuit, where the doll-button, when depressed, sends a signal to the integrated circuit, where the integrated circuit, is capable of processing electronic signals from the motion sensor, try-me button, and doll-button and sending electronic signals to the speaker, and where the two-way switch can be in the on position or limited function position, where the integrated circuit processes signals from the motion sensor when the two-way switch is in the on position, but the integrated circuit does not process signals from the motion sensor when the two-way switch is in the limited function position, where the integrated circuit, when it receives a signal from the try-me button and the two-way switch is in the limited function position, sends a signal to the speaker thereby causing the speaker to emit sound, where the integrated circuit, when it receives a signal from the doll button and the motion sensor, sends a signal to the speaker thereby causing the speaker to emit baby sounds and music, and where the integrated circuit, when it receives a signal from the motion sensor, but not the doll button, sends a signal to the speaker thereby causing the speaker to emit only music and not baby sounds, and a doll, where the doll is in the shape of a humanoid figure and comprises two eyes that open and close, and where the doll can fit into and be secured to the cradle, second, placing the doll into the cradle such that the doll-button is depressed, third, setting the two-way switch to the limited function position, and fourth, pushing the try-me button.

2. The method of claim 1, further comprising the steps of:

fifth, setting the two-way switch to the on position, and sixth, rocking the cradle back and forth such that the motion sensor senses a rocking motion thereby causing the motion sensor to send a signal to the integrated circuit, which then in turn sends a signal to the speaker thereby causing the speaker to emit sound.

* * * * *